US007552907B2

(12) United States Patent
Anderson

(10) Patent No.: US 7,552,907 B2
(45) Date of Patent: Jun. 30, 2009

(54) ONE WAY VALVE FOR FLUID EVACUATION FROM A CONTAINER

(75) Inventor: Brent Anderson, Barrington, IL (US)

(73) Assignee: CTI Industries, Inc., Barrington, IL (US)

( * ) Notice: Subject to any disclaimer, the term of this patent is extended or adjusted under 35 U.S.C. 154(b) by 0 days.

(21) Appl. No.: 12/080,134

(22) Filed: Apr. 1, 2008

(65) Prior Publication Data

US 2008/0230429 A1 Sep. 25, 2008

Related U.S. Application Data

(63) Continuation of application No. 11/020,380, filed on Dec. 22, 2004, now Pat. No. 7,398,953, and a continuation of application No. 11/092,384, filed on Mar. 29, 2005.

(51) Int. Cl.
*F16K 31/44* (2006.01)

(52) U.S. Cl. ..... 251/82; 383/66; 383/100

(58) Field of Classification Search ..... 251/77, 251/82, 331; 383/103
See application file for complete search history.

(56) References Cited

U.S. PATENT DOCUMENTS

| | | | |
|---|---|---|---|
| 2,772,692 | A | 12/1956 | Russel |
| 2,778,173 | A | 1/1957 | Taunton |
| 3,949,934 | A | 4/1976 | Goglio |
| 4,756,422 | A | 7/1988 | Kristen |
| 5,067,208 | A | 11/1991 | Herrington, Jr. et al. |
| 5,088,971 | A | 2/1992 | Herrington |
| 5,131,121 | A | 7/1992 | Herrington, Jr. et al. |
| 5,161,286 | A | 11/1992 | Herrington, Jr. et al. |
| 5,203,458 | A | 4/1993 | Cornwell |
| 5,332,095 | A | 7/1994 | Wu |
| 5,442,837 | A | 8/1995 | Morgan |
| 5,450,963 | A | 9/1995 | Carson |
| 5,701,996 | A | 12/1997 | Goto et al. |
| 5,836,056 | A | 11/1998 | Porchia et al. |
| 5,924,173 | A | 7/1999 | Dobreski et al. |
| 5,931,189 | A | 8/1999 | Sweeney et al. |
| 5,950,285 | A | 9/1999 | Porchia et al. |
| 6,010,244 | A | 1/2000 | Dobreski et al. |
| 6,033,113 | A | 3/2000 | Anderson |
| 6,036,364 | A | 3/2000 | Heuvel |
| 6,071,011 | A | 6/2000 | Thomas et al. |
| 6,074,096 | A | 6/2000 | Tilman |
| 6,092,931 | A | 7/2000 | Tilman |
| 6,131,248 | A | 10/2000 | Tomic |
| 6,145,810 | A | 11/2000 | Connolly et al. |
| 6,152,600 | A | 11/2000 | Tomic |
| 6,156,363 | A | 12/2000 | Chen et al. |
| 6,161,271 | A | 12/2000 | Schreiter |

(Continued)

FOREIGN PATENT DOCUMENTS

| | | |
|---|---|---|
| EP | 1 431 211 A1 | 6/2004 |
| JP | 01-139346 | 5/1989 |
| JP | 09-131846 | 5/1997 |

*Primary Examiner*—John K Fristoe, Jr.
(74) *Attorney, Agent, or Firm*—Joseph A. Fuchs; Rockey, Depke & Lyons, LLC

(57) ABSTRACT

The present invention provides a container assembly having: (1) a flexible wall defining fluid tight chamber; (2) a valve body attached to the flexible; (3) a plunger associated with the valve body and moveable with respect to the valve body from a first position to a second position; and (4) a diaphragm positioned in the valve body for opening and closing the valve.

19 Claims, 4 Drawing Sheets

U.S. PATENT DOCUMENTS

| | | | |
|---|---|---|---|
| 6,164,826 | A | 12/2000 | Petkovsek |
| 6,199,256 | B1 | 3/2001 | Revnew et al. |
| 6,210,038 | B1 | 4/2001 | Tomic |
| 6,217,215 | B1 | 4/2001 | Tomic |
| 6,231,236 | B1 | 5/2001 | Tilman |
| 6,247,843 | B1 | 6/2001 | Buchman |
| 6,247,844 | B1 | 6/2001 | Tomic et al. |
| 6,264,366 | B1 | 7/2001 | Custer |
| 6,273,607 | B1 | 8/2001 | Buchman |
| 6,286,999 | B1 | 9/2001 | Cappel et al. |
| 6,287,000 | B1 | 9/2001 | Buchman |
| 6,287,001 | B1 | 9/2001 | Buchman |
| 6,290,390 | B1 | 9/2001 | Buchman |
| 6,290,391 | B1 | 9/2001 | Buchman |
| 6,290,393 | B1 | 9/2001 | Tomic |
| 6,306,071 | B1 | 10/2001 | Tomic |
| 6,327,754 | B1 | 12/2001 | Belmont et al. |
| 6,347,885 | B1 | 2/2002 | Buchman |
| 6,357,915 | B2 | 3/2002 | Anderson |
| 6,361,209 | B1 | 3/2002 | LaRue et al. |
| 6,361,211 | B1 | 3/2002 | Tilman |
| 6,364,530 | B1 | 4/2002 | Buchman |
| 6,376,035 | B1 | 4/2002 | Dobreski et al. |
| 6,386,760 | B1 | 5/2002 | Tomic |
| 6,402,375 | B1 | 6/2002 | Schreiter et al. |
| 6,409,066 | B1 | 6/2002 | Schneider et al. |
| 6,409,384 | B1 | 6/2002 | Provan et al. |
| 6,419,391 | B2 | 7/2002 | Thomas |
| 6,439,770 | B2 | 8/2002 | Catchman |
| 6,450,686 | B1 | 9/2002 | May |
| 6,461,042 | B1 | 10/2002 | Tomic et al. |
| 6,467,956 | B1 | 10/2002 | Tilman et al. |
| 6,470,551 | B1 | 10/2002 | Provan et al. |
| 6,474,866 | B2 | 11/2002 | Buchman |
| 6,481,890 | B1 | 11/2002 | VandenHeuvel |
| 6,491,432 | B2 | 12/2002 | May |
| 6,499,878 | B1 | 12/2002 | Dobreski et al. |
| 6,517,242 | B1 | 2/2003 | Buchman |
| 6,524,002 | B2 | 2/2003 | Tomic |
| 6,527,444 | B1 | 3/2003 | Buchman |
| 6,533,456 | B1 | 3/2003 | Buchman |
| 6,572,266 | B2 | 6/2003 | Buchman |
| 6,575,625 | B2 | 6/2003 | Cappel et al. |
| 6,594,872 | B2 | 7/2003 | Cisek |
| 6,595,486 | B2 | 7/2003 | Chen |
| 6,604,634 | B2 | 8/2003 | Su |
| 6,609,353 | B1 | 8/2003 | McMahon et al. |
| 6,612,002 | B1 | 9/2003 | Savicki |
| 6,622,353 | B2 | 9/2003 | Provan et al. |
| 6,663,283 | B1 | 12/2003 | Cappel |
| 6,686,005 | B2 | 2/2004 | White et al. |
| 6,698,926 | B2 | 3/2004 | Buchman |
| 6,709,157 | B2 | 3/2004 | VandenHeuvel et al. |
| 6,712,334 | B2 | 3/2004 | Motonaka et al. |
| 6,712,509 | B2 | 3/2004 | Cappel |
| 6,712,510 | B2 | 3/2004 | Schneider et al. |
| 6,713,152 | B2 | 3/2004 | Chen et al. |
| 6,715,187 | B1 | 4/2004 | Wang |
| 6,733,622 | B2 | 5/2004 | McMahon et al. |
| 6,743,330 | B2 | 6/2004 | Crevier |
| 6,751,932 | B1 | 6/2004 | Matthews |
| 6,796,015 | B2 | 9/2004 | Cortigiano, Sr. |
| 6,799,680 | B2 | 10/2004 | Mak |
| 6,804,935 | B2 | 10/2004 | Schneider et al. |
| 6,810,639 | B1 | 11/2004 | McMahon et al. |
| 6,810,641 | B2 | 11/2004 | Ausnit |
| 6,810,642 | B2 | 11/2004 | Cortigiano, Sr. |
| 6,811,528 | B1 | 11/2004 | Chen |
| 6,817,763 | B2 | 11/2004 | Tomic |
| 6,821,589 | B2 | 11/2004 | Dobreski et al. |
| 6,840,675 | B2 | 1/2005 | Knight |
| 6,840,897 | B2 | 1/2005 | Knight |
| 6,842,973 | B2 | 1/2005 | Share et al. |
| 6,843,600 | B2 | 1/2005 | Tilman et al. |
| 6,846,108 | B2 | 1/2005 | Buchman |
| 6,846,544 | B2 | 1/2005 | Buchman |
| 6,854,887 | B2 | 2/2005 | Anderson |
| 6,863,645 | B2 | 3/2005 | Crunkleton et al. |
| 6,866,420 | B2 | 3/2005 | Buchman |
| 6,874,298 | B2 | 4/2005 | McMahon et al. |
| 6,874,937 | B2 | 4/2005 | Ausnit |
| 6,880,972 | B2 | 4/2005 | Plourde |
| 6,880,973 | B2 | 4/2005 | Schneider et al. |
| 6,883,210 | B1 | 4/2005 | Savicki |
| 6,884,208 | B2 | 4/2005 | Haws |
| 6,895,725 | B2 | 5/2005 | Cortigiano, Sr. |
| 6,896,409 | B2 | 5/2005 | Plourde et al. |
| 6,901,637 | B2 | 6/2005 | Machacek |
| 6,902,091 | B2 | 6/2005 | Cortigiano, Sr. |
| 6,904,735 | B2 | 6/2005 | McMahon et al. |
| 6,948,849 | B2 | 9/2005 | Schreiter |
| 7,008,106 | B2 | 3/2006 | Cappel |
| 7,040,808 | B2 | 5/2006 | Rehwinkel et al. |
| 2001/0053253 | A1 | 12/2001 | Buchman et al. |
| 2002/0012479 | A1 | 1/2002 | Tomic |
| 2002/0064320 | A1 | 5/2002 | May |
| 2002/0064321 | A1 | 5/2002 | Schreiter |
| 2002/0064322 | A1 | 5/2002 | May |
| 2002/0076122 | A1 | 6/2002 | Buchman |
| 2002/0090151 | A1 | 7/2002 | Skeens et al. |
| 2002/0117215 | A1 | 8/2002 | Skeens |
| 2002/0196987 | A1 | 12/2002 | Tilman et al. |
| 2003/0021499 | A1 | 1/2003 | Buchman |
| 2003/0063820 | A1 | 4/2003 | Buchman |
| 2003/0169949 | A1 | 9/2003 | Buchman |
| 2003/0185945 | A1 | 10/2003 | Buchman |
| 2003/0202718 | A1 | 10/2003 | Tomic |
| 2003/0202720 | A1 | 10/2003 | VandenHeuvel et al. |
| 2003/0223654 | A1 | 12/2003 | Gerrits |
| 2003/0228075 | A1 | 12/2003 | Buchman |
| 2004/0022461 | A1 | 2/2004 | Schreiter |
| 2004/0037477 | A1 | 2/2004 | Buchman |
| 2004/0086206 | A1 | 5/2004 | Tomic |
| 2004/0091179 | A1 | 5/2004 | Anderson |
| 2004/0120610 | A1 | 6/2004 | Buchman |
| 2004/0131283 | A1 | 7/2004 | Sprague et al. |
| 2004/0136615 | A1 | 7/2004 | Tilman et al. |
| 2004/0136617 | A1 | 7/2004 | Gerrits |
| 2005/0036717 | A1 | 2/2005 | Wu et al. |
| 2005/0036718 | A1 | 2/2005 | Wu et al. |
| 2005/0036719 | A1 | 2/2005 | Wu et al. |
| 2005/0063617 | A1 | 3/2005 | Tilman |
| 2005/0063621 | A1 | 3/2005 | Kettner et al. |
| 2005/0135710 | A1 | 6/2005 | Melchoir |
| 2005/0147330 | A1 | 7/2005 | Lee |
| 2005/0244084 | A1 | 11/2005 | Tilman et al. |
| 2005/0286808 | A1 | 12/2005 | Zimmerman et al. |
| 2005/0286810 | A1 | 12/2005 | Sprague et al. |
| 2005/0286811 | A1 | 12/2005 | Sprague et al. |
| 2005/0286812 | A1 | 12/2005 | Sprague et al. |
| 2006/0003879 | A1 | 1/2006 | Buchman |
| 2006/0029301 | A1 | 2/2006 | Schreiter |
| 2006/0029302 | A1 | 2/2006 | Buchman |
| 2006/0072854 | A1 | 4/2006 | Schreiter |
| 2006/0104548 | A1 | 5/2006 | Schreiter |
| 2006/0110079 | A1 | 5/2006 | Zimmerman et al. |
| 2006/0133700 | A1 | 6/2006 | Cappel |
| 2006/0171610 | A1 | 8/2006 | Buchman et al. |
| 2006/0182371 | A1 | 8/2006 | Borchardt |
| 2006/0193540 | A1 | 8/2006 | Borchardt |

FIG. 3
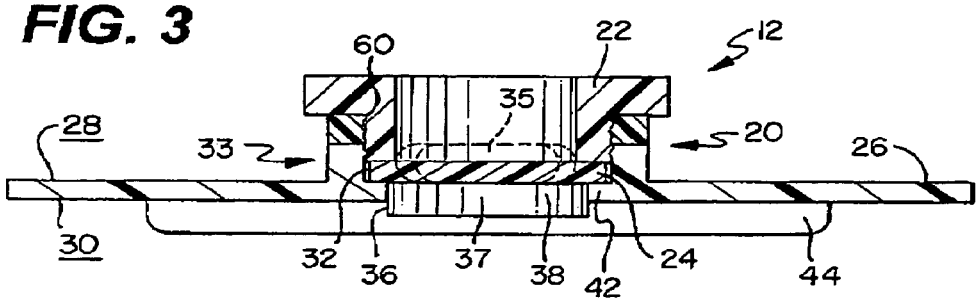
FIG. 4
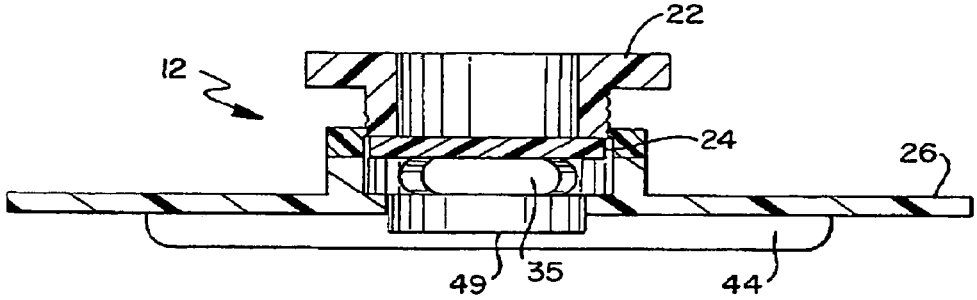
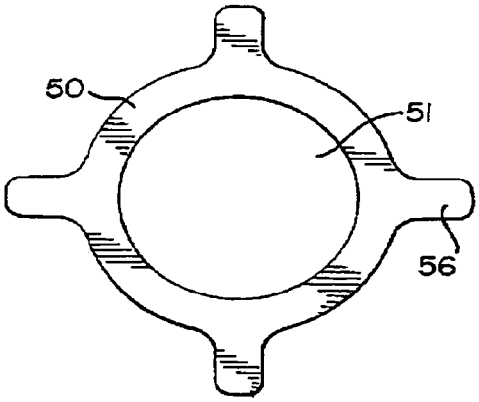
FIG. 5
FIG. 6
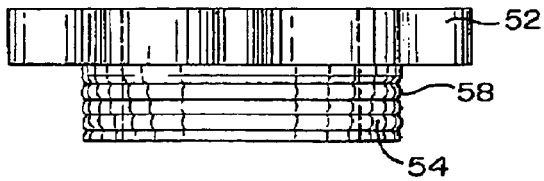

ONE WAY VALVE FOR FLUID EVACUATION FROM A CONTAINER

CROSS-REFERENCE TO RELATED APPLICATION

This Application is a continuation of U.S. patent application Ser. No. 11/020,380, filed Dec. 22, 2004, now U.S. Pat. No. 7,398,953 and U.S. patent application Ser. No. 11/092,384, filed Mar. 29, 2005, the disclosures of each is incorported herein by reference in their entirety and made a part hereof.

FEDERALLY SPONSORED RESEARCH OR DEVELOPMENT

Not Applicable.

BACKGROUND OF THE INVENTION

1. Technical Field

The present invention relates to collapsible containers for storing compressible articles, such as linen and clothing, and in particular to evacuable storage containers.

2. Background Art

Collapsible, evacuable storage containers typically include a flexible, fluid-tight bag, an opening through which to place an article in the bag, and a fixture through which to evacuate excess air. A user places an article into the enclosure through the opening, seals the opening, and then evacuates the fluid through the fixture. With the chamber thus evacuated, the article contained therein may be significantly compressed, so that it is easier to transport and requires substantially less storage space.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

One such container was developed by James T. Cornwell (U.S. Pat. No. 5,203,458). That patent described a disposable, evacuable container for sealing and compressing contaminated surgical garments for ease of storage and transportation prior to disposal.

Another such enclosure is described in a patent to Akihiro Mori and Ichiro Miyawaki (Japanese Pat. No. 01-139346). In that device, the opening through which the stored article is placed requires the application of a heat source, such as a home iron, to form an effective seal.

These and other aspects and attributes of the present invention will be discussed with reference to the following drawings and accompanying specification

BRIEF DESCRIPTION OF THE DRAWINGS

FIG. 3 is a cross-sectional view of an embodiment of a valve of the present invention in a closed position;

FIG. 4 is a cross-sectional view of an embodiment of a valve of the present invention in an open position;

FIG. 5 is a top view of an embodiment of a plunger of the present invention;

FIG. 6 is a side view of the plunger shown in FIG. 5;

DETAILED DESCRIPTION OF THE INVENTION

Figure 1:
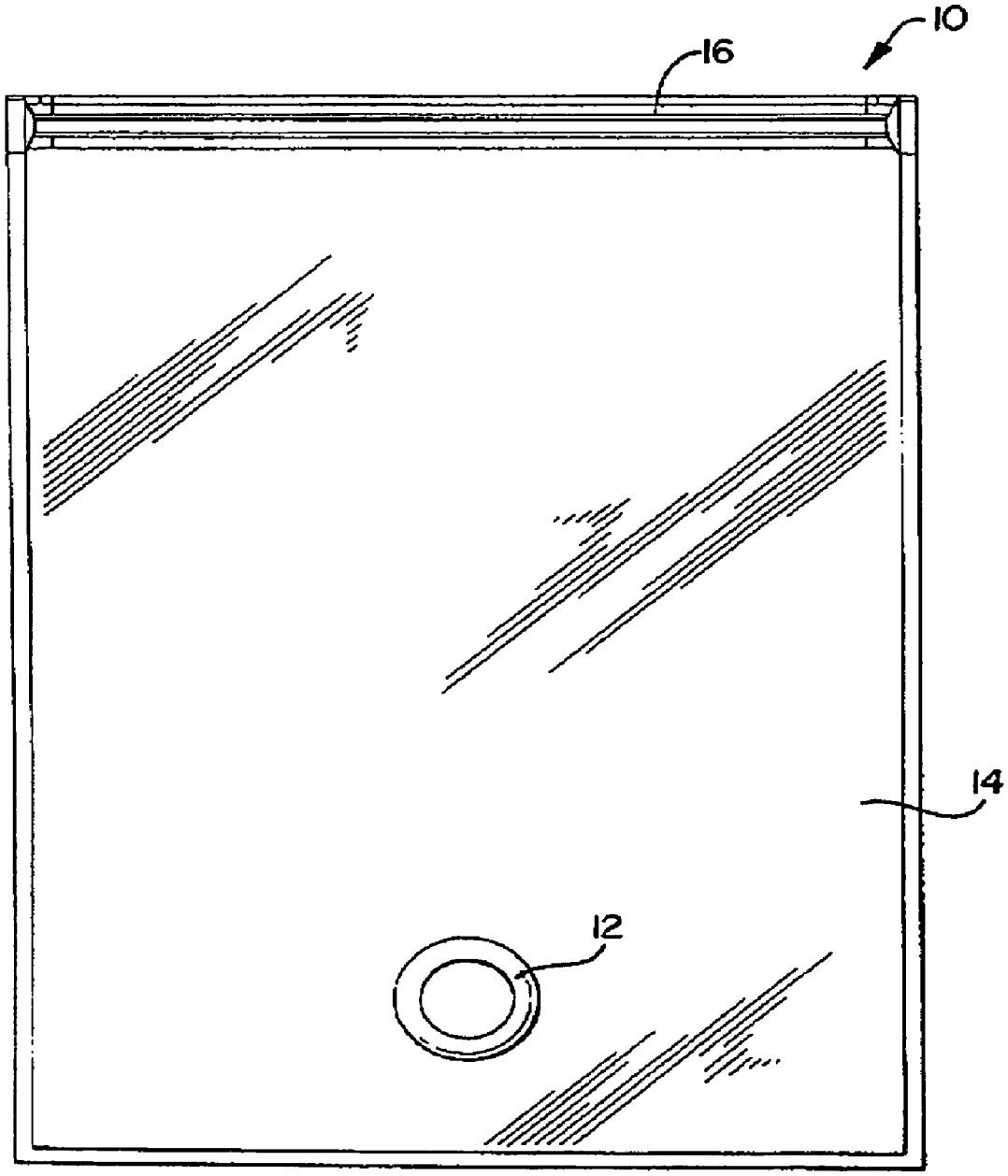
FIG. 1 is a perspective view of a container and closure assembly of the present invention with the container being in a sealed position.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
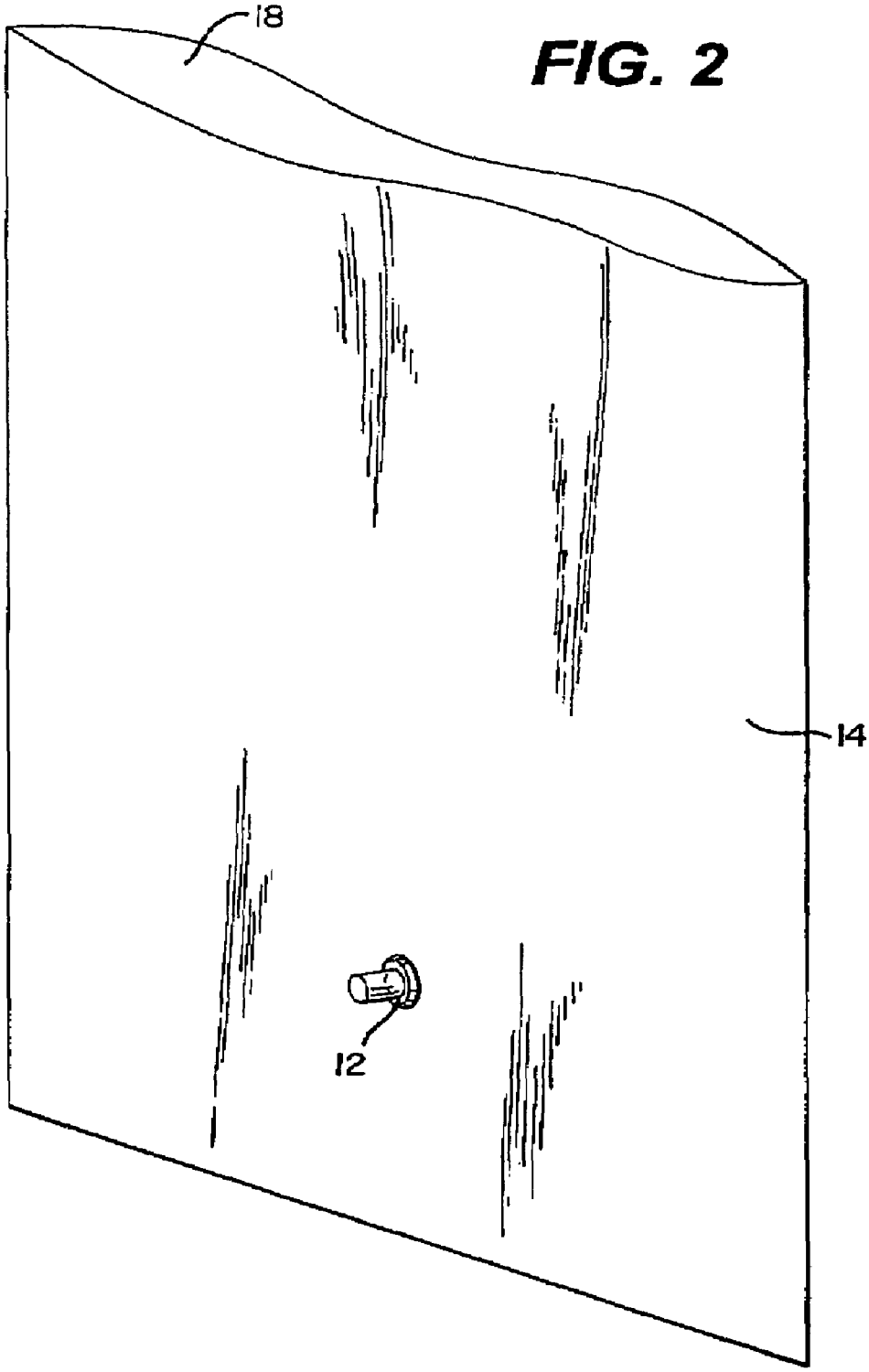
FIG. 2 is a perspective view of a container and closure assembly of the present invention with the container being in an unsealed position.
Figure 7:
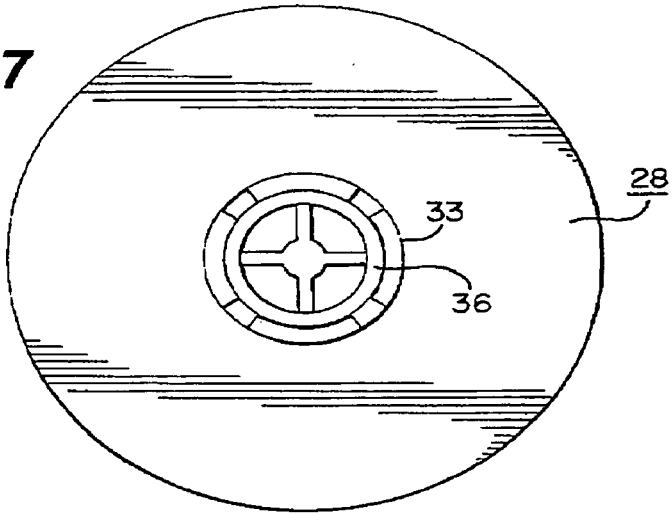
FIG. 7 is a top view of a valve of the present invention.

FIGS. 1 and 2 show a container assembly or system 10 having a closure assembly 12 and a container 14. The closure assembly includes a one-way valve that allows for evacuation of fluid from the container but does not allow a significant quantity of fluid to enter the container through the assembly 12. In one preferred form of the invention the container 14 is capable of being opened and closed repeatedly without the use of a tool or heat source by utilizing a zipper 16 or other member for sealing an end of the container. FIG. 2 shows the container in an unsealed position with an opening 18 at an end of the container for loading articles into the container. The container is suitable for storing compressible articles sealed from the surrounding environment and maintaining a fluid tight seal. Excess fluid in the container can be removed by applying a suction to the closure assembly using a household vacuum cleaner or other suction device. Removal of excess fluid reduces the size of the compressible article and by maintaining a minimal fluid content, such as air and water, inhibits the growth of insects, mold, mildew and other bacteria, which may damage the contents of the container. Moreover, in a preferred form of the invention, the sealed container and closure assembly provide a barrier to the passage of fluids to further inhibit the growth and propagation of bacteria, mold and mildew among other organisms over an extended period of time.

FIGS. 3 and 4 show the closure assembly 12 having a valve body 20, a plunger 22 and a diaphragm 24. FIG. 3 shows the closure assembly 12 in a first, closed position and FIG. 4 shows the closure assembly in a second, open position. The valve body 20 has an annular flange 26 having a first surface 28 and an opposed second surface 30, a centrally disposed opening 32 through the flange, and a cylindrical wall 33 extends from the first surface and is disposed circumjacent the opening 32 and defines a first fluid pathway 34 therethrough. The first cylindrical wall has a plurality of circumferentially spaced openings 35.

Figure 8:
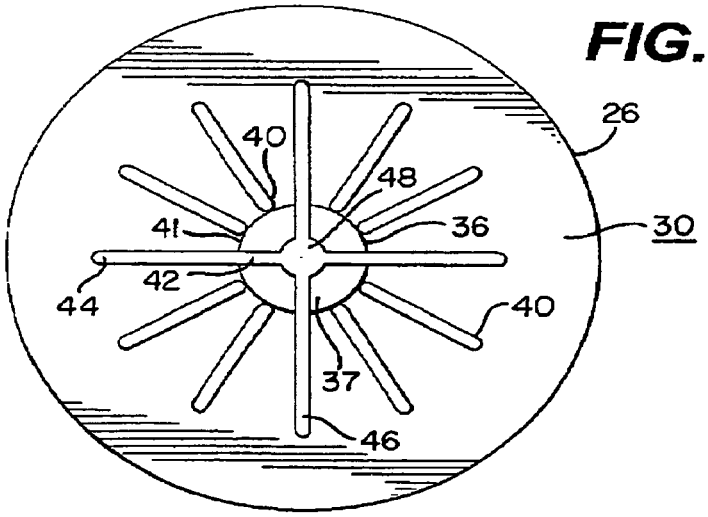
FIG. 8 is a bottom view of a valve of the present invention.

A second cylindrical wall 36 extends from the second surface 30 and has a fluid inlet 37 at a distal end and defines a second fluid pathway 38 therethrough that is in fluid communication with the opening 32. The fluid inlet 37 is sealed by the diaphragm 24 when the closure assembly is in the closed position and is uncovered when the closure assembly is in the open position. The second cylindrical wall 36 is circumferentially surrounded by a plurality of radially extending and circumferentially spaced fins 39 (See also FIG. 8) each of which have an end 40 terminating at an outer periphery 41 of the second cylindrical wall 36.

A valve supporting surface 42 is positioned in a generally central portion of the second fluid passageway and has a generally cruciform shaped member 43 having a first arm 44 a second arm 46 transverse to the first arm and has a generally circular platform 48 joining the first arm to the second arm. The valve supporting surface 42 extends across the entire diametrical dimension of the second cylindrical wall 36 and extends from the second surface 30 beyond a distal end 49 of the wall. The fins and the cruciform shaped member add rigidity to the valve assembly and reduce the tendency for the fluid inlet 37 to become closed or partially closed by the sidewalls of the container or by articles within the container.

In a preferred form of the invention the valve body 20 is fabricated from a polymeric material by an injection molding technique. Suitable polymeric materials for the valve body include polymers, copolymers and terpolymers fabricated from one or more chemical groups including olefins, dienes, amides, esters, vinyl chlorides, vinyl alcohols, vinyl acetates, urethanes, imides, ethers, sulfones, styrenes, acrylonitrile, acrylates, substituted acrylates, and blends of polymers, copolymers and terpolymers derived from these chemical groups. In one preferred form of the invention the valve body is fabricated from the terpolymer acrylonitrile-butadiene-styrene or from the homopolymer polypropylene, or from a copolymer of propylene with minor proportions, say less than 6% by weight, of ethylene.

FIGS. 5 and 6 show the plunger 22 having a generally cylindrical shaped wall 50 defining a central fluid pathway 51. The plunger 22 has a flange portion 52 and a stem portion 54. FIG. 6 shows the flange portion includes several circumferentially spaced knobs 56 for hand gripping. The stem portion 54 extends coaxially within the valve body and has a set of threads 58 for cooperative engagement with mating threads 60 in the valve body 12. In a preferred form of the invention, the threads are coarse for moving the plunger between the first position shown in FIG. 3 to the second position shown in FIG. 4 with less than one complete 360° rotation of the plunger.

It is contemplated that instead of threads the plunger could have a flange or protuberance that would cooperatively engage a flange or protuberance in the valve body to allow the plunger to slide within the valve body without becoming disassembled. Such a plunger could be moved from the first position to the second position when a vacuum is applied. It is also contemplated there could be a first stop that releasably holds the plunger in the first position and a second stop that releasably holds the plunger in the second position.

Figure 9:
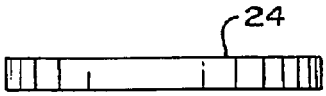
FIG. 9 is a side view of a diaphragm of the present invention.
Figure 10:
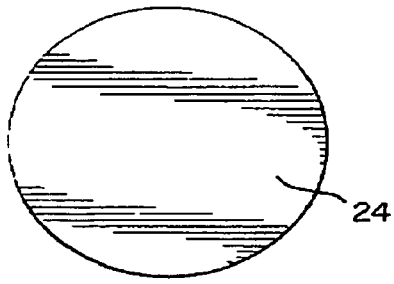
FIG. 10 is a top view of a diaphragm of the present invention.

FIGS. 9 and 10 show the diaphragm 24 which is dimensioned to fit within the valve body and has a generally uniform thickness across its entire diametric dimension. The diaphragm is moveable from a third position to a fourth position, shown respectively in FIGS. 3 and 4, when the plunger is in the second position (FIG. 4). When the diaphragm is in the third position it cooperates with the plunger to block the fluid inlet 37 and when the diaphragm is in the fourth position fluid is allowed to flow through the fluid inlet 37and the fluid passageways 35. The diaphragm is preferably fabricated from a material that has a density that allows it to be moved in response to a suction applied to the valve body. Suitable materials for the diaphragm include paper, plastic, rubber, cork or metal. In another preferred form of the invention, the diaphragm will have a density of less than about 1.2 g/cc. In yet another preferred form of the invention, the diaphragm will be fabricated from silicone or polyvinyl chloride.

In a preferred form of the invention, the zipper closure 16 is constructed in accordance with commonly assigned U.S. Pat. No. 6,033,113 or U.S. Patent Application No. 2004/0091179A1 each of which is incorporated herein by reference and made a part hereof. The zippered closure is typically made of plastic. Often associated with the zippered closure is a slider that facilitates sealing the zippered closure. The slider closes and can open the zippered closure. Examples of sliders include those disclosed in U.S. Pat. Nos. 6,306,071; 6,287,001; 6,264,366; 6,247,844; 5,950,285; 5,924,173; 5,836,056; 5,442,837; 5,161,286; 5,131,121; 5,088,971; and 5,067,208 each of which is incorporated herein by reference and made a part hereof.

The container 14 can be rigid, semi-rigid or flexible and, in a preferred form of the invention, should be capable of being sealed to form a fluid tight chamber. The container 14 can be permanently sealed or, as is shown in FIGS. 1 and 2, can be capable of being closed and reopened. What is meant by the term "flexible" is the material used to fabricate the container will have a mechanical modulus when measured according to ASTM D-882 of less than 40,000 psi. The term "semi-rigid" will refer to materials having a mechanical modulus of from 40,000 psi to 100,000 psi. The term "rigid" will refer to materials having a mechanical modulus of greater than 100,000 psi.

For containers that are permanently sealed fluid can be delivered to the container through an access member such as a tube, port, valve, spout, fitment or the like. The term "fluid" refers to liquids or gasses.

The container 14 can be fabricated from metal, paper, and plastic. Suitable plastics include the polymers set forth above for the valve body. The container can be fabricated from a monolayer film, a multiple layer film or from more than one ply of material where a portion of the plies are sealed together but the individual plies are not joined across their entire surface area. It is contemplated the container can be fabricated from a multiple layer structure having one or more layers of polymeric materials and one or more layers of paper or metals. Metals such as aluminum are known to provide significant barriers to water vapor transmission and to the transmission of gasses such as oxygen, nitrogen, helium, hydrogen and others. Also, polymers such as ethylene vinyl alcohol and polyamides are commonly used as they also provide significant barrier properties.

The container assembly 10 shown in FIGS. 1 and 2 includes the steps of providing a container, making a hole in the container dimensioned to fit the valve body 12, inserting the valve body 12 into the hole with the second surface 30 extending into the chamber of the container and the flange 26 contacting a surface of the container and providing heat directly or indirectly to the flange to weld the flange and valve body 12 to the container.

The container 14 can be evacuated of fluids by first moving the plunger from the first position to the second position either by rotating the plunger, sliding the plunger or the like, then applying a suction through a hose or the like using a household vacuum cleaner or other device such as a pump that is capable of generating a suction to remove fluid from the container through the valve body. Upon applying the suction the diaphragm is free to move from the third position to the fourth position where fluid can flow through the fluid passageways 35 and out of the container. After evacuation is complete the suction should be removed. The diaphragm will be moved by gravity or by a suction from the container to partially or fully close the fluid passageways 35. The plunger should then be moved back to the first position to maintain a fluid tight seal by locking the diaphragm in the third position.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A container assembly comprising:

a flexible first wall of a polymeric material, the wall defining a fluid tight chamber;

a valve body attached to the first wall and having a second wall, a fluid inlet a fluid outlet and a flange having opposed first and second surfaces and a centrally disposed opening through the flange, a first cylindrical wall extends from the first surface and is disposed circumjacent the opening, the first cylindrical wall having a fluid exit through the wall and in fluid communication with the opening, the valve body having a first member for attaching the valve body to the flexible first wall of the container and a second member proximate the fluid inlet adapted to reduce the tendency for a portion of the flexible wall of the container to block the flow of fluid through the fluid inlet;

a plunger associated with the valve body and moveable with respect to the valve body from a first position to a second position; and a diaphragm positioned in the valve body for movement between a third position and a fourth position when the plunger is in the first position, wherein when the diaphragm is in the third position the fluid outlet is closed and when the diaphragm is in the fourth position the fluid outlet is open, the diaphragm moves from the fourth position to the third position in response to fluid flow through the valve body in a first direction from the fluid outlet toward the fluid inlet.

2. The assembly of claim 1 wherein the first wall is a monolayer structure, a multiple layer structure or a multiple ply structure.

3. The assembly of claim 1 wherein when the plunger is in the first position a portion of the plunger presses the diaphragm into the third position.

4. The assembly of claim 3 wherein the plunger is mounted to the valve body for reciprocating movement.

5. The assembly of claim 4 wherein the plunger has a flange, a stem and a longitudinally extending axis and wherein a portion of the stem extends into the valve body.

6. The assembly of claim 4 wherein the plunger is mounted to the valve seat with mating threads and the plunger is moveable from the first position to the second position by rotating the plunger about the axis.

7. The assembly of claim 4 wherein the plunger is mounted to the valve body for sliding engagement and wherein the plunger is moved from the first position to the second position by applying a force to the plunger in the direction of the axis.

8. The assembly of claim 5 wherein the stem defines a fluid passageway therethrough.

9. The assembly of claim 1 further comprising a second cylindrical wall extending from the second surface and defining a fluid passageway circumjacent the opening and in fluid communication therewith.

10. The assembly of claim 9 further comprising a valve supporting surface extending axially across a portion of the fluid passageway.

11. The assembly of claim 10 wherein the valve supporting surface extends across a distal end of the second cylindrical wall and across the entire diametric dimension thereof

12. The assembly of claim 11 wherein the valve supporting surface comprises a first arm a second arm transverse to the first arm and a generally circular platform joining the first arm to the second arm.

13. The assembly of claim 12 wherein the circular platform is disposed substantially centrally within the fluid passageway of the second cylindrical wall.

14. The assembly of claim 13 wherein the valve supporting surface comprises a member extending across an axially portion of the annular wall.

15. The assembly of claim 13 wherein the valve supporting surface comprises a generally cruciform shaped member extending across the opening.

16. The assembly of claim 15 wherein the cruciform shaped member comprises a first arm, a second arm and a circular platform disposed in a central portion of the opening and connecting the first arm to the second arm.

17. The assembly of claim 1 wherein the diaphragm has density of less than 1.2 g/cc.

18. The assembly of claim 1 wherein the diaphragm is fabricated from a material selected from the group consisting of paper, plastic, rubber, cork or metal.

19. The assembly of claim 1 wherein the diaphragm is made from polyvinyl chloride or silicone.

* * * * *